US006531017B1

(12) United States Patent
Fukui et al.

(10) Patent No.: US 6,531,017 B1
(45) Date of Patent: Mar. 11, 2003

(54) COLOR IMAGE-FORMING METHOD AND TRANSFER SHEET USED FOR THE METHOD

(75) Inventors: Takuto Fukui, Osaka (JP); Toshiyuki Yamane, Osaka (JP); Kyouichi Suzuki, Osaka (JP); Hideki Suematsu, Osaka (JP)

(73) Assignee: Fujicopian Co., Ltd., Osaka-Fu (JP)

( * ) Notice: Subject to any disclaimer, the term of this patent is extended or adjusted under 35 U.S.C. 154(b) by 0 days.

(21) Appl. No.: 09/473,399

(22) Filed: Dec. 28, 1999

(30) Foreign Application Priority Data

Dec. 28, 1998 (JP) ..... 10-373642

(51) Int. Cl.[7] ..... B41M 5/30
(52) U.S. Cl. ..... 156/235; 428/195
(58) Field of Search ..... 156/235; 428/195, 428/352, 354, 484, 488.1, 488.4, 913, 914

(56) References Cited

FOREIGN PATENT DOCUMENTS

JP 403203684 A * 9/1991
JP A 05-77568 3/1993
JP 407164771 A * 6/1995

* cited by examiner

*Primary Examiner*—Bruce H. Hess
(74) *Attorney, Agent, or Firm*—Fish & Neave

(57) ABSTRACT

A color image-forming method, comprising the steps of: using a transfer sheet comprising a foundation, a release layer and a colored ink layer stacked in this order on one side of the foundation wherein the release layer is capable of being fused or softened by heat at the time of a thermal transferring process and the colored ink layer is incapable of being softened by heat at the time of the thermal transferring process; and an image receiving body having at least a surface layer capable of being fused or softened by heat at the time of the thermal transferring process, superposing the colored ink layer of the transfer sheet onto the image receiving body and heating the transfer sheet/image receiving body from the transfer sheet side to form a color image on the image receiving body.

7 Claims, No Drawings

COLOR IMAGE-FORMING METHOD AND TRANSFER SHEET USED FOR THE METHOD

BACKGROUND OF THE INVENTION

The present invention relates to a color image forming method which can provide color images that are superior in gradation reproducibility and dot reproducibility, including variable performance, color superposing property and color clearness, and that also have high recording density. The present invention also relates to a transfer sheet used in such a method.

In a conventional thermal transferring recording system using a colored ink layer that is fused by heat, ink located other than dots is also fused (or softened) by the diffusion of heat generated from a heating resistor element (dot). As a result, ink transfer occurs at portions that need not be subjected to the transferring process, which, in turn, causes problems of unstable dot shapes and irregular gradations.

In order to solve the above-mentioned problems of the prior art, an object of the present invention is to provide a color image forming method and a transfer sheet used in such a method, which can achieve color images that are superior in gradation reproducibility, dot reproducibility, color superposing property and color clearness, and also have high recording density, when used in a thermal transfer color printer.

This and other objects of the present invention will become apparent from the description hereinafter.

SUMMARY OF THE INVENTION

The present invention provides (1) a color image-forming method, comprising the steps of:

using a transfer sheet comprising a foundation, and a release layer and a colored ink layer stacked in this order on one side of the foundation wherein the release layer is capable of being fused or softened by heat at the time of a thermal transferring process and the colored ink layer is incapable of being softened by heat at the time of the thermal transferring process; and an image receiving body having at least a surface layer capable of being fused or softened by heat at the time of the thermal transferring process, superposing the colored ink layer of the transfer sheet onto the image receiving body and heating the transfer sheet/image receiving body from the transfer sheet side to form a color image on the image receiving body, wherein, in the case of a transferring process for a first color, the colored ink layer is transferred by allowing the image-receiving body side to be fused or softened so as to exert adhesive property; and in the case of a transferring process of a second color or a subsequent color, with respect to a monocolor portion of the second color or the subsequent color, in the same manner as the first color, the colored ink layer is transferred by allowing the image-receiving body side to be fused or softened so as to exert adhesive property, and with respect to an overlapped area on at least one of the first color, the second color and the subsequent color which have been transferred, the colored ink layer for the second color or the subsequent color is transferred by allowing a release layer component on the top of a printed image of at least one of the first color, the second color or the subsequent color to be fused or softened to exert adhesive property.

The present invention further provides (2) a transfer sheet for use in the color image forming method according to the above (1), wherein the colored ink layer incapable of being softened by heat at the time of the thermal transferring process comprises a binder and a pigment as its essential components, the binder comprising a substance incapable of being softened by heat at the time of the thermal transferring process, the pigment comprising 30 to 90% by weight of the colored ink layer, the thickness of the colored ink layer being in the range of 0.05 to 0.5 $\mu$m.

The present invention further provides (3) the transfer sheet according to the above (2), wherein the release layer capable of being fused or softened by heat at the time of the thermal transferring process comprises an organic polymer having a softening point of 50° to 170° C. and fine particles.

The present invention further provides (4) the transfer sheet according to the above (3), wherein the organic polymer and the fine particles comprise 70 to 10% by weight and 30 to 90% by weight, respectively, of the release layer and the thickness of the release layer is in the range of 0.02 to 0.5 $\mu$m.

DETAILED DESCRIPTION

The inventors of the present invention have studied intensively to achieve the above-mentioned objects and found that when a transfer sheet having a foundation on one side of which a release layer that is thermally fused or softened and a colored ink layer that is not softened by heat at the time of a thermal transferring process are stacked in this order, and an image-receiving body having at least a surface layer that is fused or softened by heat at the time of the thermal transferring process are used in a combined manner, it becomes possible to achieve a high density recording that provides superior dot reproducibility, gradation reproducibility, color superposing property and color clearness of the first color, the second color and subsequent color, thereby completing the present invention. The following description will discuss the present invention in detail.

In the thermal transfer method of the present invention, in the case of the transferring process of the first color ink layer, different from the conventional thermally fusible transfer ink layer, the first color ink layer is not fused or softened at the time of the thermal transferring process, and the image-receiving body side is allowed to be fused or softened so as to be bonded to the ink layer. Thus, the first color ink is transferred to form a first color printed image. In the case of the transferring process of the second color ink layer, with respect to a monocolor portion of the second color, in the same manner as the first color, the second color ink is transferred by allowing the image-receiving body side to be fused or softened so as to exert adhesive property, and with respect to an overlapped area on the first color printed image, the second color ink is transferred by allowing the release layer component on the top of the first color printed image to be fused or softened so as to exert adhesive property. Thus, the second color ink is transferred to form a second color printed image. In the case of the transferring process of the third color ink layer, with respect to a monocolor portion of the third color, in the same manner as the first color, the third color ink is transferred by allowing the image-receiving body side to be fused or softened so as to exert adhesive property, and with respect to an overlapped area on the first color printed image and/or the second color printed image, the third color ink is transferred by allowing the release layer component on the top of the first color printed image and/or the second color printed image to be fused or softened so as to exert adhesive property. Thus, the third color ink is transferred to form a third color printed image. In the case of the ink layer transferring process of the fourth color and subsequent color, the transferring process is carried out in the same manner as the third color. Normally, the first color, the second color and the third color are selected from yellow, magenta and cyan, and black is used as fourth color.

In this method, the colored ink layers of the respective colors are not fused so that dot shapes are stabilized, and it becomes possible to achieve high density recording that provides superior dot reproducibility and gradation reproducibility including a variable performance and color clearness, etc. Here, the variable performance refers to a performance wherein an ink can be transferred at a predetermined area in accordance with a so-called variable dot in which a heat-generation area is variable by adjusting the energy application to the heating resistor element of a thermal head.

With respect to the foundation of the transfer sheet, various known materials used as the foundation of conventional fusing transfer or sublimation transfer sheets may be used; and a polyester film, etc., having a thickness of 2.0 to 6.0 μm with a heat-resistant layer (anti-sticking layer) is preferably used in the same manner as a normal thermal transfer sheet used for a thermal head. However, the present invention is not intended to be limited thereby.

The release layer is provided on the opposite side of the foundation with respect to the heat resistant layer. The release layer, which is releasable or separable from the foundation, contains an organic polymer, which is fused or softened by heat so as to exhibit adhesive property as an essential component. Such an organic polymer is preferably selected from those having a softening point (referred to a needle penetrating temperature measured by a method in accordance with JIS K 7196) in the range of 50° to 170° C. A softening point less than 50° C. causes degradation in the blocking resistant property at high temperatures in the transfer sheet and the resulting printed matters. A softening point exceeding 170° C. tends to cause insufficient transfer sensitivity of the release layer. Examples of organic polymers include polyolefins (polyethylene, polypropylene, etc.), modified polyolefins (oxidized polyethylene, etc.), copolymers of ethylene or propylene (ethylene/vinyl acetate copolymer, ethylene/acrylic acid copolymer, ethylene/acrylic acid copolymer ionomer resin, ethylene/acrylic acid ester copolymer, etc.), polyvinyl chloride, vinyl chloride copolymers (vinyl chloride/vinyl acetate copolymer, etc.), polyvinylidene chloride, polystyrene, copolymers of styrene or vinyltoluene (styrene/ maleic acid anhydride copolymer, styrene/maleic acid half ester copolymer, styrene/(meth) acrylic acid ester copolymer, etc.), poly(meth)acrylic acid ester, (meth)acrylic acid ester copolymer, acetal resins (polyvinyl butyral, etc.), polyamide resin, polyvinyl alcohol, polyvinyl pyrrolidone, polyethylene oxide, gelatin, polyvinylphenol, epoxy resin (novolak type epoxy resin, bisphenol A-type epoxy resin, etc.), etc. However, the present invention is not intended to be limited thereby. Moreover, two or more resins may be used in combination.

In order to allow the release layer to easily cut off between the heated portion and the non-heat portion at the time of the transferring process to improve the clearness of the transferred image, it is preferable to incorporate substantially transparent fine particles (filler) into the release layer. With respect to the fine particles, silica, alumina, titanium oxide, zinc oxide, tin oxide, smectite-type mica, calcium carbonate, cured resins, etc. are listed; however, the present invention is not intended to be limited thereby. Moreover, two or more kinds of these fine particles may be used in combination. Furthermore in order to impart an antistatic property to the release layer, known fine particles having an electric conductivity may be contained therein. Titanium oxide or zinc oxide fine particles also have ultraviolet shielding function; therefore, such fine particles are preferably used from the viewpoint of the light resistance of the transferred images.

With respect to the fine particles contained in the release layer, it is preferable to set the particle size of the particles that account for not less than 80% in the particle size distribution to not more than 0.2 μm. Moreover, the contents of the organic polymer and the fine particles are preferably in the range of 70 to 10% by weight and in the range of 30 to 90% by weight, respectively. Moreover, the thickness of the release layer is preferably in the range of 0.02 to 0.5 μm. A particle size of the fine particles exceeding the above-mentioned range causes degradation in the transparency of the release layer, with the result that color developments, exerted by superposed inks, tend to deteriorate. This causes serious adverse effects on the formation of a color image in an area gradation method. Moreover, a content of the fine particles less than the above-mentioned range makes the release layer difficult to be cut off at the time of the transferring process; this tends to cause degradation in the clearness of the recorded images. On the other hand, a content exceeding the above-mentioned range makes the release layer susceptible to cracks. In particular, when an ink layer is applied thereon, the component of the ink layer enter the cracks, resulting in degradation in the transferability in these portions. Moreover, a thickness of the release layer thicker than 0.5 μm reduces the clearness of the images. On the other hand, a thickness less than 0.02 μm causes degradation in shielding the foundation against the component of a coating liquid for the upper layer, resulting in a reduction in the transferability.

Moreover, with respect to the kind of organic polymers used for the release layer, it is preferable to take into account the solvent of the upper layer that will be applied thereon. In other words, it is undesirable for the solvent of the upper layer to dissolve and swell the release layer located below. This would cause the upper layer component to mix with the release layer, which, in turn, would cause deterioration in the releasability. In general, when a polar solvent is used for the upper layer, it is preferable to select an organic polymer for the release layer that can be dissolved in a solvent having a relatively low polarity. When a non-polar solvent is used for the upper layer, the above-mentioned relationship is reversed. Alternatively, an organic polymer having a low solubility to the solvent may be used in a latex form. In order to improve the surface property of the coated film and to allow a releasability controlling function to be well exerted, a fluorine-based surface active agent and a silicone-based surface active agent may be added.

The colored ink layer is composed of a binder, which is not softened by heat at the time of the thermal transferring process, and a pigment, as essential components. With respect to the binders that are not softened by heat at the time of the thermal transferring process, organic polymers having a softening point not less than 180° C. are preferably used. Organic high polymers having a softening point of not less than 200° C. are more preferably used. Examples of the organic high polymers include polyolefins (polyethylene, polypropylene, etc.), modified polyolefins (oxidized polyethylene, etc.), copolymers of ethylene or propylene (ethylene/vinyl acetate copolymer, ethylene/acrylic acid copolymer, ethylene/acrylic acid copolymer ionomer resin, ethylene/acrylic acid ester copolymer, etc.), polyvinyl chloride, vinyl chloride copolymers (vinyl chloride/vinyl acetate copolymer, etc.), polyvinylidene chloride, polystyrene, copolymers of styrene or vinyltoluene (styrene/maleic anhydride copolymer, styrene/maleic acid half ester copolymer, styrene/(meth)acrylic acid ester copolymer, etc.), poly(meth)acrylic acid ester, (meth)acrylic acid ester copolymer, etc., acetal resins (polyvinyl butyral, etc.), polyamide resin, polyvinyl alcohol, polyvinylpyrrolidone, polyethylene oxide, gelatin, polyvinylphenol, cellulose derivatives (methylcellulose, ethylcellulose, hydroxymethylcellulose, cellulose acetate, cellulose diacetate, cellulose triacetate, cellulose nitrate, cellulose acetate butyrate, etc.), silicone-modified acrylate resins, fluororesins such as fluorine-containing acrylic resins, epoxy resins (novolak-type expoxy resins, bisphenol A-type epoxy resins, etc.), etc.; however, the present invention is not intended to be limited thereby. Moreover, two or more resins may be used in combination. Furthermore, a resin material which is made by a cross-linking reaction using polyisocyanate, etc. and satisfies the above-mentioned softening point conditions by a cross-linking reaction using polyisocyanate, etc. may be used.

With respect to pigments, known organic or inorganic pigments may be used. Examples of black pigments include inorganic pigments such as carbon black, graphite, triiron tetraoxide, and organic pigments such as cyanine black. Examples of inorganic yellow pigments include chrome yellow, cadmium yellow, yellow iron oxide, titanium yellow, etc. Examples of organic yellow pigments include monoazo pigments such as pigment yellow 1, 3, 65, 74, 98, 97, 13 and 169, disazo pigments such as pigment yellow 12, 13, 14, 17, 55 and 83, condensed azo pigments such as pigment yellows 93, 94 and 95, benzimidazolone monoazo pigments such as pigment yellow 154, 151, 120, 175 and 156. Moreover, isoindolynon pigments, such as pigment yellow 110, 109, 137 and 173, are listed. In addition, flavanthrone (pigment yellow 24) which is a styrene-based pigment, anthramyrimidine (pigment yellow 108), phthaloylamide-type anthraquinone (pigment yellow 123), heliofast yellow (pigment yellow 99), azo nickel complex pigments (pigment green 10) which are metal complex pigments, nitroso nickel pigments (pigment yellow 153), azo methine copper complex pigments (pigment yellow 117), phthalimide quinophthalone pigments (pigment yellow 138) which are quinophthalone pigments, etc. are listed. Magenta pigments include inorganic pigments such as cadmium red, red iron oxide, pigment red 106, minium, antimony red, etc. With respect to organic magenta pigments, azo pigments, such as pigment red 57, 57:1, 53:1, 48, 49, 60, 64, 51, 63, pigment orange 17 and 18, insoluble azo pigments (monoazo, disazo and condensed azo), such as pigment red 1, 2, 3, 9, 112, 114, 5, 150, 146, 170, 187, 185, 38, 166, 144, and pigment orange 5, 31, 38, 36, 16 and 13, are listed. With respect to anthraquinone pigments which are condensed polycyclic pigments, pigment orange 40, 168, pigment red 177, etc. are listed. With respect to thioindigo pigments, pigment violet 38, 36, pigment red 88, etc. are listed. Moreover, with respect to perylene pigments, pigment red 190, 123, 179, 149, 178, etc. are listed. With respect to quinacridone pigments, pigment red 122, 206, 207, pigment violet 19, etc. are listed. With respect to cyan pigments, inorganic pigments such as ultramarine blue, Prussian blue, cobalt blue and cerulean blue are listed. With respect to organic cyan pigments, phthalocyanine pigments such as pigment blue, 15, 15:1, 15:3, 17, pigment green 7, 36, and pigment violet 23 are listed. Styrene-based pigments indanthrone blue (PB-60P, PB-22, PB-21, PB-64), basic dye lake pigments, etc. may also be used. In addition, various white pigments, etc. may be used. Two or more pigments may be used in combination. Moreover, an oil soluble dye, etc. may be used in combination as a colorant, if desired.

With respect to the pigment contained in the colored ink layer, it is preferable to set the particle size of the particles that account for not less than 80% in the particle size distribution to not more than 0.2 $\mu$m, from the view point of the optical reflection density of transferred images. Moreover, in the colored ink layer, the contents of the organic polymer that is not softened by heat at the time of the transferring process and the pigment are preferably in the range of 70 to 10% by weight (more preferably, 60 to 30% by weight) and in the range of 30 to 90% by weight (more preferably, 40 to 70% by weight), respectively. Moreover, the thickness of the colored ink layer is preferably in the range of 0.05 to 0.5 $\mu$m. A particle size of the pigment exceeding 0.2 $\mu$m causes degradation in the smoothness of the surface of the colored ink layer, with the result that the transferability of the second color ink and the subsequent color ink in the overlapped area tends to be lowered. A content of the pigment less than the above-mentioned range makes the cutting-off property of the colored ink layer insufficient, resulting in degradation in the dot reproducibility. On the other hand, a content exceeding the above-mentioned range causes a reduction in the ink strength, making the colored ink fall off the foundation. A thickness of the colored ink layer less than 0.05 $\mu$m tends to fail to provide a sufficient optical reflection density. On the other hand, a thickness exceeding 0.5 $\mu$m tends to cause degradation in the gradation reproducibility such as blurred dots in high density region and failure in transfer of dots in low density region with respect to the area gradation reproducibility.

In order to allow the colored ink layer to easily cut off between the heated portion and the non-heat portion at the time of the transferring process to improve the clearness of the transferred image, it is preferable to incorporate substantially transparent fine particles (filler) into the colored ink layer. With respect to such fine particles, silica, alumina, titanium oxide, zinc oxide, tin oxide, smectite-type mica, calcium carbonate, cured resins, etc. are listed; however, the present invention is not intended to be limited thereby. Moreover, two or more kinds of these fine particles may be used in a combined manner. Furthermore, additives such as a dispersing agent and a surface active agent may be added to the colored ink layer appropriately in a range so as not to impair the object of the present invention.

With respect to the transfer sheet of the present invention, colored ink layers of a plurality of colors, for example, ink layers such as yellow, magenta and cyan, and optionally an ink layer of black may be provided in a side-by-side relation on a single foundation, or the respective colored ink layers may be provided on separate foundations.

Usable as the image-receiving body in the present invention may be those wherein an image-receiving layer composed of an organic polymer that is fused or softened by heat at the time of thermal transferring process, is provided on a base member made of various paper materials, synthesized paper, a plastic film, etc. by coating or laminating. With respect to the organic polymers that are fused or softened by heat at the time of the thermal transferring process, those having a softening point in the range of 50° to 170° C. are preferably used. A softening point less than 50° C. causes degradation in the blocking resistant property, particularly, at high temperatures, and a softening point exceeding 170° C. tends to cause failure in transfer of the colored ink. Moreover, in order to secure the adhesive property to the colored ink layer of the transfer sheet, it is preferable to adjust the surface energy of the image-receiving layer of the image-receiving body to be a value similar to the surface energy of the colored ink. For this reason, for example, the organic polymer used in the colored ink layer and the organic polymer used in the image-receiving body are selected so as to have similar solubility parameters (SP values). Moreover, in order to prevent variations in the transfer sensitivity of the first color (to be transferred onto the image-receiving body) and the second color and subsequent color (to be transferred on the image-receiving body at the monocolor portion and to be transferred on the release layer of the printed image at the overlapped area), it is preferable to set the softening point and the surface energy of the image-receiving layer to values similar to those of the release layer. Examples of the organic polymer that is fused or softened by heat at the time of the thermal transferring process include water soluble resins such as polyvinyl alcohol having various molecular weights and saponification values and derivatives thereof, polyvinyl butyral, sodium polyacrylate, polyvinylpyrrolidone, polyamide resin, acrylamide/acrylic acid ester copolymer, acrylamide/acrylic acid ester/ metacrylic acid ester copolymer, polyacrylamide and its derivatives and polyethylene glycol, and polyvinyl acetate, styrene/butadiene copolymer, acrylonitrile/butadiene copolymer, polyacrylic ester, vinyl chloride/vinyl acetate copolymer, polybutyl methacrylate, ethylene/vinyl acetate copolymer, styrene/butadiene/acrylic copolymer, etc.; however, the present invention is not intended to be limited thereby. These materials may be used alone, or two or more may be used in combination.

From the view point of the degree of whiteness and the shielding property, the image-receiving layer may contain the following pigments: for example, inorganic pigments such as zinc oxide, titanium oxide, calcium carbonate, silicic acid, silicate, clay, talc, mica, sintered clay, aluminum hydroxide, barium sulfate, lithopone and colloidal silica, and organic pigments referred to as plastic pigments wherein plastics such as polystyrene, polyethylene, polypropylene, epoxy resin, styrene/acrylic copolymer are processed into various shapes such as a true round sphere and a hollow shape; however, the present invention is not intended to be limited thereby. Moreover, these pigments may be used alone or two or more may be used in combination. Furthermore, an antistatic layer or a curl prevention layer which may be selected from a wide range of materials may be formed on the rear side of the image-receiving body, if necessary.

Moreover, with respect to the image-receiving body, instead of providing the image-receiving layer, an image-receiving body, all of which is composed of an organic polymer, which is fused or softened by heat at the time of thermal transferring process, may be used. As the organic polymer for the image-receiving layer, those having a softening point in the range of 50° to 170° C. are preferably used. Organic polymer sheets that are fused or softened by heat at the time of the transferring process can be used including sheets of polyester, polyolefin, polyamide, polyester amide, polyether, polypropylene, polycarbonate, polyethylene, polyvinyl chloride, polyvinylidene chloride, and poly(meth)acrylic ester, and composite sheets in which the foregoing sheets are combined, etc.; however, the present invention is not intended to be limited thereby.

The following description will discuss the present invention in detail by means of examples. However, the scope of the present invention is not intended by these examples.

The present invention will be described in more detail by way of Examples. It is to be understood that the present invention will not be limited to the Examples, and various changes and modifications may be made in the invention without departing from the spirit and scope thereof.

EXAMPLE 1

Preparation of Transfer Sheet

On one side of a polyethylene terephthalate film having a thickness of 4.5 μm was formed an anti-sticking layer made of a modified silicone resin having a thickness of 0.1 μm, and onto the other side thereof was applied a release layer ink as indicated below by using a Mayer bar and dried at 60° C. to form a release layer having a thickness of

| Release layer ink | |
|---|---|
| Components | Parts by weight |
| Polyamide (Softening point: 97.7° C., SP value: 10.2) | 40.0 |
| Synthesized silica (Average particle size: 0.01 μm, 80% particle size: 0.08 μm) | 60.0 |
| Methanol | 950.0 |
| Water | 950.0 |

Onto the above-mentioned release layer was applied each of colored inks having respective colors shown below by using a Mayer bar and dried at 60° C. to form each of colored ink layers having the respective colors, each having a thickness of 0.3 μm; thus, three kinds of transfer sheets of yellow, magenta and cyan were obtained.

| Components | Parts by weight |
|---|---|
| Yellow ink | |
| Yellow pigment (C.I. Pigment Yellow 14) | 51.0 |
| Dispersing agent (Solsperse 24000 (made by ICI Japan Kabushiki Kaisha) | 9.0 |
| Cellulose diacetate (Softening point: not less than 300° C., SP value: 11.0) | 40.0 |
| Surface active agent | 0.06 |
| Methyl ethyl ketone | 660.0 |
| Magenta ink | |
| Magenta pigment (C.I. Pigment Red 57:1) | 54.0 |
| Dispersing agent (Solsperse 24000 (made by ICI Japan Kabushiki Kaisha) | 6.0 |
| Cellulose diacetate (Softening point: not less than 300° C., SP value: 11.0) | 40.0 |
| Surface active agent | 0.06 |
| Methyl ethyl ketone | 660.0 |
| Cyan ink | |
| Cyan pigment (C.I. Pigment Blue 15:3) | 54.0 |
| Dispersing agent (Solsperse 24000 (made by ICI Japan Kabushiki Kaisha) | 6.0 |
| Cellulose diacetate (Softening point: not less than 300° C., SP value: 11.0) | 40.0 |
| Surface active agent | 0.06 |
| Methyl ethyl ketone | 660.0 |

Preparation of Image-receiving Sheet

Onto one side of a polyethylene terephthalate film having a thickness of 100 μm was applied the following image-receiving layer ink by using a Mayer bar and dried to form an image-receiving layer having a thickness of 2.0 μm.

| Image-receiving layer ink | |
|---|---|
| Components | Parts by weight |
| Polyvinyl butyral (Softening point: 60.9° C., SP value: 11.0) | 10.0 |
| Methyl ethyl ketone | 90.0 |

EXAMPLE 2

Except that the resin material used in the manufacture of the image-receiving body of Example 1 was changed to that described below, the same procedures as in Example 1 were carried out to obtain an image-receiving body. With respect to the transfer sheet, the same one as Example 1 was used.

| Image-receiving layer ink | |
|---|---|
| Components | Parts by weight |
| Polyamide (Softening point: 104.2° C., SP value: 10.2) | 10.0 |
| Methyl ethyl ketone | 90.0 |

Comparative Example 1

Except that the ink for the colored layer in Example 1 was changed to that described below, the same procedures as in Example 1 were carried out to obtain a transfer sheet. Here, polyvinyl butyral used for the inks of the respective colors is a resin that is softened at the time of the thermal transferring process. With respect to the image-receiving body, the same one as in Example 1 was used.

| Components | Parts by weight |
|---|---|
| Yellow ink | |
| Yellow pigment (C.I. Pigment Yellow 14) | 51.0 |
| Dispersing agent (Solsperse 24000 (made by ICI Japan Kabushiki Kaisha) | 9.0 |
| Polyvinyl butyral (Softening point: 60.9° C., SP value: 11.0) | 40.0 |
| Surface active agent | 0.06 |
| Methyl ethyl ketone | 660.0 |
| Magenta ink | |
| Magenta pigment (C.I. Pigment Red 57:1) | 54.0 |
| Dispersing agent (Solsperse 24000 (made by ICI Japan Kabushiki Kaisha) | 6.0 |
| Polyvinyl butyral (Softening point: 60.9° C., SP value: 11.0) | 40.0 |
| Surface active agent | 0.06 |
| Methyl ethyl ketone | 660.0 |
| Cyan ink | |
| Cyan pigment (C.I. Pigment Blue 15:3) | 54.0 |
| Dispersing agent (Solsperse 24000 (made by ICI Japan Kabushiki Kaisha) | 6.0 |
| Polyvinyl butyral (Softening point: 60.9° C., SP value: 11.0) | 40.0 |
| Surface active agent | 0.06 |
| Methyl ethyl ketone | 660.0 |

Comparative Example 2

In Example 1, only each of the colored layer inks of the respective colors was directly applied to the foundations to obtain transfer sheets of yellow, magenta, and cyan each having a single-layer construction. With respect to the image-receiving body, the same one as in Example 1 was used.

By using the combinations of the transfer sheets and the image-receiving bodies obtained as described above, first color (yellow), second color (magenta) and third color (cyan) were printed in a superposed manner in that order by means of a line-type thermal transfer printer having a variable dot-type thermal head, evaluation was made on the dot reproducibility and the graduation reproducibility. The results are shown in Table 1.

Printing Conditions

Dot density: 300 dots/inch

Printing speed: 250 mm/sec

Printing energy: 40.0 mJ/mm$^2$ (maximum)

Printing pattern: variable 256 gradation pattern (The density gradations were represented by changing the printing energy in 256 stages.)

Dot Reproducibility (Shape)

Dot shapes of all the gradations (particularly, highlighted region occupying not more than 10% of the area of the image region) were visually observed, and evaluation was made based upon the following standard.

◎—Neither blurred portions nor drop-out portions are found, providing superior dot reproducibility.

○—Hardly any blurred portions or drop-out portions are found, providing superior dot reproducibility.

Δ—Blurred portions and drop-out portions tend to appear, resulting in slight degradation in dot reproducibility.

X—Blurred portions and drop-out portions appear, resulting in degradation in dot reproducibility.

Dot Reproducibility (Variations)

Variations in size and density of dots in all the gradation regions (particularly, highlighted region occupying not more than 10% of the area of the image region) were visually-observed, and evaluation was made based upon the following standard.

◎—Dots having a uniform size and density are reproduced in the same gradation region.

○—Dots having an almost uniform size and density are reproduced in the same gradation region.

Δ—Slight variations appear in dot size and density in the same gradation region.

X—Variations appear in dot size and density in the same gradation region.

<Gradation Reproducibility>

The number of recognizable gradations obtained corresponding to the respective printing energies for 256 gradations was counted, and evaluation was made based upon the following standard.

○—Not less than 96 gradations
Δ—32 to 95 gradations
X—Less than 32 gradations

TABLE 1

| | Dot reproducibility | | | | Gradation | |
|---|---|---|---|---|---|---|
| | Shape | | Variation | | reproducibility | |
| | 1st-order color | 2nd-order color to 3rd-order color | 1st-order color | 2nd-order color to 3rd-order color | 1st-order color | 2nd-order color to 3rd-order color |
| Ex. 1 | ◎ | ○ | ◎ | ○ | ○ | ○ |
| Ex. 2 | ○ | ○ | ○ | ○~Δ | ○ | ○ |
| COM. Ex. 1 | ○ | Δ | ○ | Δ | Δ | Δ |
| COM. Ex. 2 | ◎ | x | ◎ | x | ○ | x |

According to the color image-forming method of the present invention, it becomes possible to form images that are superior in gradation reproducibility and dot reproducibility, including variable performance, and color clearness and that also have high recording density.

What is claimed is:

1. A color image-forming method for superposition of at least a first-color and a second color or a subsequent color, comprising the steps of:

using a transfer sheet comprising a foundation, and a release layer and a colored ink layer stacked in this order on one side of the foundation wherein the release layer comprises an organic polymer having a softening point of 50° to 170° C. and is capable of being fused or softened by heat at the time of a thermal transferring process and the colored ink layer is incapable of being softened by heat at the time of the thermal transferring process; and an image receiving body having at least a surface layer capable of being fused or softened by heat at the time of the thermal transferring process, superposing the colored ink layer of the transfer sheet onto the image receiving body and heating the transfer sheet/image receiving body from the transfer sheet side to form a color image on the image receiving body, wherein, for the first color, the colored ink layer is transferred by allowing the image-receiving body side to be fused or softened so as to exert adhesive property; and for the second color or the subsequent color, with respect to a monocolor portion of the second color or the subsequent color, in the same manner as the first color, the colored ink layer is transferred by allowing the image-receiving body side to be fused or softened so as to exert adhesive property, and with respect to an overlapped area on at least one of the first color, the second color and the subsequent color which have been transferred, the colored ink layer for the second color or the subsequent color is transferred by allowing a release layer component on the top of a printed image of at least one of the first color, the second color or the subsequent color to be fused or softened to exert adhesive property.

2. A transfer sheet for use in the color image forming method according to claim 1, the transfer sheet comprising a foundation, and a release layer and a colored ink layer stacked in this order on one side of the foundation, wherein the release layer comprises an organic polymer having a softening point of 50° to 170° C. and is capable of being fused or softened by heat at the time of a thermal transferring process and the colored ink layer is incapable of being softened by heat at the time of the thermal transferring process, and wherein the colored ink layer comprises a binder and a pigment as its essential components, the binder comprising a substance incapable of being softened by heat at the time of the thermal transferring process, wherein the substance has a softening point of not less than 180° C., the pigment comprising 30 to 90% by weight of the colored ink layer, the thickness of the colored ink layer being in the range of 0.05 to 0.5 $\mu$m.

3. The transfer sheet according to claim 2, wherein the release layer capable of being fused or softened by heat at the time of the thermal transferring process comprises an organic polymer having a softening point of 50° to 170° C. and fine particles.

4. The transfer sheet according to claim 3, wherein the organic polymer and the fine particles comprise 70 to 10% by weight and 30 to 90% by weight, respectively, of the release layer and the thickness of the release layer is in the range of 0.02 to 0.5 $\mu$m.

5. The color-image forming method according to claim 1, wherein the colored ink layer incapable of being softened by heat at the time of the thermal transferring process comprises a binder and a pigment as its essential components, the binder comprising a substance incapable of being softened by heat at the time of the thermal transferring process, wherein the substance has a softening point of not less than 180° C., the pigment comprising 30 to 90% by weight of the colored ink layer, the thickness of the colored ink layer being in the range of 0.05 to 0.5 $\mu$m.

6. The color-image forming method according to claim 1, wherein the release layer capable of being fused or softened by heat at the time of the thermal transferring process comprises an organic polymer having a softening point of 50° to 170° C. and fine particles.

7. The color-image forming method according to claim 6, wherein the organic polymer and the fine particles comprise 70 to 10% by weight and 30 to 90% by weight, respectively, of the release layer and the thickness of the release layer is in the range of 0.02 to 0.5 $\mu$m.

* * * * *